US007415800B2

(12) United States Patent
Stienwand

(10) Patent No.: US 7,415,800 B2
(45) Date of Patent: Aug. 26, 2008

(54) COLUMBARIUM WITH IMPROVED SECURITY

(76) Inventor: Harry Stienwand, Box 25, Ta Ta Creek (CA) V0B 2H0

( * ) Notice: Subject to any disclaimer, the term of this patent is extended or adjusted under 35 U.S.C. 154(b) by 281 days.

(21) Appl. No.: 10/731,046

(22) Filed: Dec. 9, 2003

(65) Prior Publication Data

US 2004/0177570 A1 Sep. 16, 2004

(30) Foreign Application Priority Data

Mar. 11, 2003 (CA) ..... 2421667

(51) Int. Cl.
*E04H 9/16* (2006.01)

(52) U.S. Cl. ..... 52/136; 52/137; 52/140; 27/35; 27/1; 109/68; 109/85

(58) Field of Classification Search ..... 52/137, 52/139, 140, 136, 142; 109/76, 67, 68, 85; 312/326; 70/166; 49/65, 67; 27/1, 30, 35
See application file for complete search history.

(56) References Cited

U.S. PATENT DOCUMENTS

| | | | | | |
|---|---|---|---|---|---|
| 912,368 | A * | 2/1909 | Downey | 52/136 |
| 1,606,151 | A * | 11/1926 | Dahnke | 109/68 |
| 2,524,105 | A * | 10/1950 | Hacker | 49/67 |
| 3,754,805 | A * | 8/1973 | Pangbum et al. | 312/111 |
| 3,888,055 | A * | 6/1975 | Gallo | 52/98 |
| 3,958,378 | A * | 5/1976 | Omeechevarria | 52/136 |
| 4,073,100 | A * | 2/1978 | DiGiovanni, Jr. | 52/79.3 |
| 4,389,817 | A * | 6/1983 | Olberding | 49/163 |
| 4,408,546 | A * | 10/1983 | Schmidt | 109/75 |
| 4,523,413 | A * | 6/1985 | Koppenberg | 52/139 |
| 4,614,066 | A * | 9/1986 | Koppenberg | 52/134 |
| 4,685,402 | A * | 8/1987 | Nelson et al. | 109/65 |
| 5,134,758 | A * | 8/1992 | Christensen | 27/35 |
| 5,195,812 | A | 3/1993 | Eickhof | |
| 5,315,798 | A * | 5/1994 | Zarwell | 52/202 |
| 5,477,594 | A * | 12/1995 | LePage | 27/1 |
| 5,740,637 | A * | 4/1998 | Snow | 52/136 |
| 5,881,505 | A | 3/1999 | Larkin, III et al. | |
| 5,979,124 | A | 11/1999 | Branan | |
| 6,250,025 | B1 * | 6/2001 | Darby | 52/137 |
| 6,513,352 | B1 * | 2/2003 | Mainville | 70/166 |
| 6,578,323 | B1 * | 6/2003 | Zartman et al. | 52/134 |

FOREIGN PATENT DOCUMENTS

| | | | | |
|---|---|---|---|---|
| CA | 2270697 | | 10/2000 | |
| EP | 282809 | * | 9/1988 | 109/76 |
| JP | 5-86760 | * | 4/1993 | 109/68 |

* cited by examiner

*Primary Examiner*—Phi Dieu Tran A
(74) *Attorney, Agent, or Firm*—Joshua King; Graybeal Jackson Haley LLP

(57) ABSTRACT

A columbarium apparatus comprises a columbarium structure defining a plurality of niches. Each niche has an open end, and a horizontal ledge extends from the structure near the bottom wall of each niche. An inside door is configured to cover the open end of the niche and is attached by a first set of tamper resistant hardware, and an outside door is configured to cover the inside door and conceal the first set of tamper proof hardware, and is attached by a second set of tamper resistant hardware such that an inner face of the outer door is supported by an outer face of the inside door, and such that a lower edge of the outside door is supported by the ledge. A vertical channel is provided to facilitate attachment of the outside doors.

7 Claims, 3 Drawing Sheets

COLUMBARIUM WITH IMPROVED SECURITY

FIELD OF THE INVENTION

This invention is in the field of columbaria for storing cremains, and in particular systems for securing such columbaria against tampering.

BACKGROUND

It is commonly known to store cremains in above ground in a columbarium. To be attractive to families, it is desired that these columbaria have an appearance of permanence, dignity, and security where the remains of a loved one can be secure.

Such columbaria are disclosed, for example in U.S. Pat. No. 6,250,025 to Darby, U.S. Pat. No. 5,979,124 to Branan, U.S. Pat. No. 5,881,505 to Larkin, III et al., and U.S. Pat. No. 5,195,812 to Eickhof, and in Canadian Patent Application Number 2,270,697 of Mainville. The disclosed columbaria generally comprise a plurality of boxes, commonly referred to as niches, in an array of closely adjacent rows and columns. The niches are of a size to accommodate a cremains urn, and have an open front end for insertion of the urn that is conventionally closed by a relatively thin stone door. A dust door is often placed in the open end of the niche prior to installing the outer door to prevent the entry of dust and insects.

Stone, such as granite, is preferred for the doors because of its attractive and enduring appearance, however as can be seen in the above prior art, such doors are relatively thin in order to maintain the doors at a manageable weight, and reduce cost. As a result the stone doors can be broken by vandals without great difficulty.

The outer door, as illustrated in the disclosures of Darby, Branan, Eickhof, and Mainville, is secured to the columbaria by tamper-proof hardware such as screws, brackets, hooks, or the like to close the front of the niche in a manner that at least makes removal difficult without special tools. Branan and Mainville are directed particularly to providing door attachment systems that prevent removal of the door by vandals or other unauthorized personnel. These prior systems however do not address the fragility of the stone doors themselves, which are often broken by vandals. Once the stone door is broken, the urn is exposed and subject to theft or damage.

SUMMARY OF THE INVENTION

It is the object of the present invention to provide a columbarium apparatus that overcomes problems in the prior art. It is a further object of the present invention to provide such a columbarium apparatus that improves security of the cremains stored therein by providing an inner door, preferably of aluminum, behind and supporting an outer door, generally desired to be stone. It is a further object of the present invention to provide such a columbarium apparatus wherein stone doors are more conveniently attached to the structure.

In a first aspect the invention provides a columbarium apparatus comprising at least one niche defined by a columbarium structure, and having an open end. An inside door is configured to cover the open end of the niche and is attached to the columbarium structure by a first set of tamper resistant hardware. An outside door is configured to cover the inside door and is attached to the columbarium structure by a second set of tamper resistant hardware such that an inner face of the outside door is supported by an outer face of the inside door.

In a second aspect the invention provides a columbarium apparatus comprising a columbarium structure defining a plurality of niches. Each niche is defined by top, bottom, right side, left side, and rear walls and has an open end. A horizontal ledge extends from the columbarium structure in proximity to the bottom wall of each niche. An inside door is configured to cover the open end of the niche and is attached to the columbarium structure by a first set of tamper resistant hardware, and an outside door is configured to cover the inside door and conceal the first set of tamper proof hardware, and is attached to the columbarium structure by a second set of tamper resistant hardware such that an inner face of the outer door is supported by an outer face of the inside door, and such that a lower edge of the outside door is supported by the ledge.

The invention improves security of the stored cremains by increasing the difficulty experienced by unauthorized persons attempting to gain access to the cremains. A vertical channel along each side of the columbarium apparatus also makes installation of the doors more convenient.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

FIGS. 1-7 illustrate a columbarium apparatus 1 comprising a columbarium structure 2 that is made from aluminum panels. The aluminum provides a lightweight structure 2 that can be readily manufactured and shipped, and that is highly resistant to corrosion. The columbarium structure 2 defines a plurality of niches 4 oriented in an array of rows and columns, as illustrated, or in another desired arrangement. Each niche is defined by top, bottom, right side, left side, and rear walls and has an open end 6.

Figure 1:
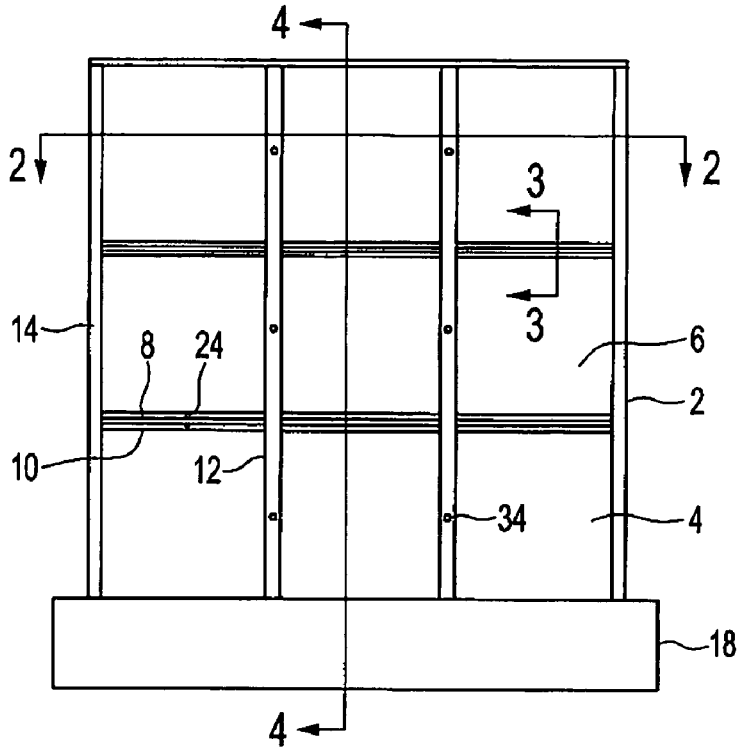
FIG. 1 is a front view of a columbarium apparatus of the invention, with the doors removed.
Figure 2:
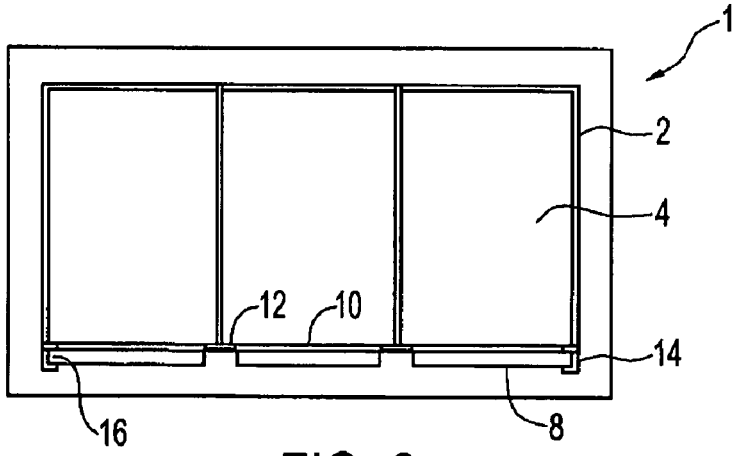
FIG. 2 is a schematic cross sectional view along line 2-2 in FIG. 1.
Figure 3:
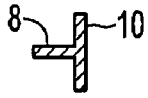
FIG. 3 is a cross sectional view along line 3-3 in FIG. 1.
Figure 4:
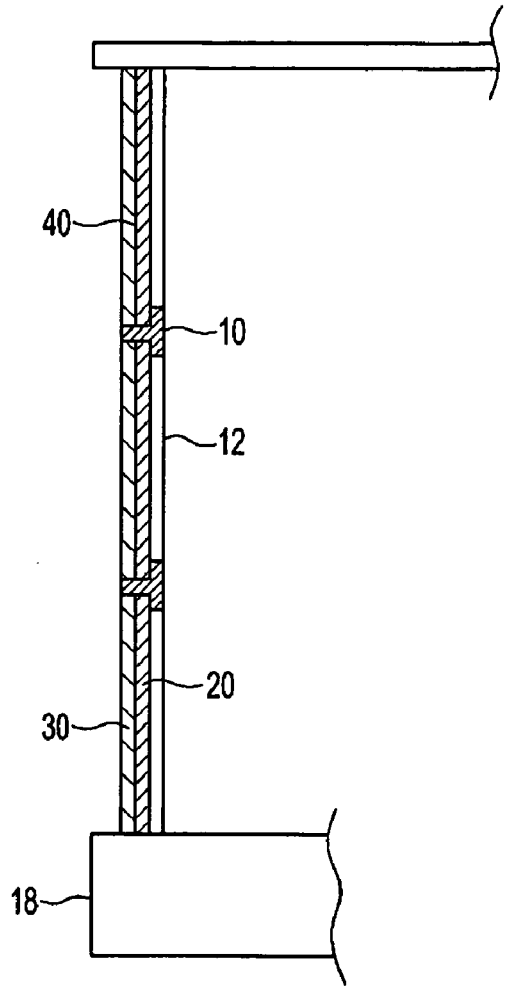
FIG. 4 is a schematic cross sectional view along line 4-4 in FIG. 1 showing the doors installed.
Figure 5:
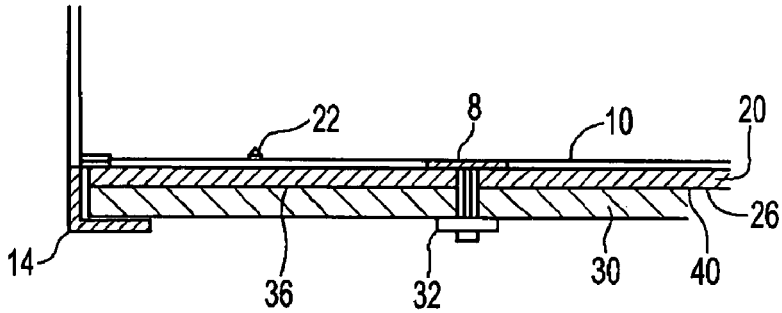
FIG. 5 is a cross sectional view along line 5-5 in FIG. 6.
Figure 7:
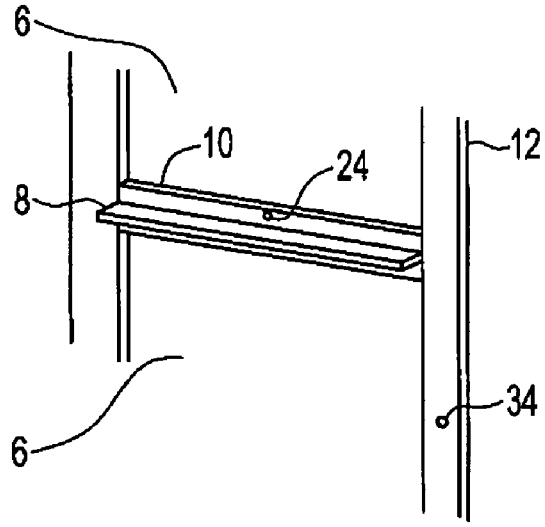
FIG. 7 is a perspective view of the t-bar and vertical strip of the embodiment of FIG. 1.

A horizontal ledge 8 extends from the columbarium structure 2 in proximity to the bottom wall of each niche 4. An aluminum t-bar 10 oriented as seen in FIGS. 3 and 7 conveniently provides this ledge 8. In the illustrated embodiment the open ends 6 of the niches 4 have a vertical strip 12 along each side. A channel member 14 runs vertically along each outside edge of the columbarium structure 2. The channel members 14 define recesses 16 facing each other across the front of the columbarium structure 2.

An inside door 20 is configured to cover the open end 6 of the niche 4 and is attached to the columbarium structure by a first set of tamper resistant hardware, illustrated as an inside security screw 22 through a hole in the inside door 20 and screwed into a threaded hole 24 located in the t-bar 10. The embodiment illustrated shows top and bottom threaded holes 24 in the middle of the location of the inside door 20, however more holes 24 and screws 22 oriented in a different configuration could be provided if desired.

The inside security screws 22 are countersunk into the inside door 20 so as to be flush with the outer face 26 of the inside door 20, and have a head that can only be engaged by a non-standard tool that is not readily available to unauthorized personnel. Such security screws are known in different configurations that require various different tools for removal. The inside door 20 is preferably aluminum which is strong and light, and the inside security screws 22 or like hardware are made from stainless steel or brass that will not oxidize when in contact with the aluminum of the columbarium structure 2.

Figure 6:
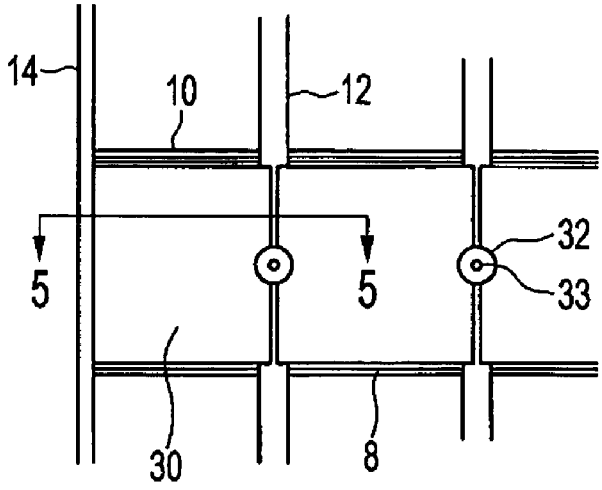
FIG. 6 is front view of a niche of the apparatus with the doors in place over the open end of the niche.

An outside door 30 is configured to cover the inside door 20 and is attached to the columbarium structure 2 by a second set of tamper resistant hardware, illustrated as comprising a rosette 32 and an outside security screw 33 screwed into threaded hole 34 in the vertical member 12. As illustrated in FIG. 6, in the middle column of niches 4, the outer doors 30 are attached by a rosette 32 on each side. For the outer columns of niches 4, the outer doors 30 slide into the recess 16 defined by the channel members 14, and so need only be secured by a single rosette 32 on the opposite side.

The channel member 14 conveniently and attractively reduces the number of rosettes 32 needed to secure the outer doors 30, and provides for more convenient attachment. Instead of locating holes 34 for attachment of rosettes 32 at a mid-point of the sides of the outside doors 30, the holes 34 could be located at the corners, such that each rosette could cover the corners of four adjacent outside doors, as is seen in some of the prior art.

Conveniently the outer door is supported on the ledge 8 while being attached, instead of on a lower door as in some of the prior art. The ledge 8 also thus facilitates removal of lower doors which are not required to support a door above. The ledge 8 also ensures even spacing of the outside doors 30. The bottom row of outside doors 30 conveniently rests on a base 18.

Thus in the columbarium apparatus 1 of the invention, the inner face 36 of the outside door 30 is supported by the outer face 26 of the inside door 20. Commonly it will be desired to have the outer door be made of granite or like stone which can be easily broken by vandals or the like. The inner door 20 strengthens the outer door 30 by supporting the rear face 36 thereof, making it more difficult to break. Preferably a layer of silicone compound 40 or like resilient material is placed between the inside and outside doors to cushion the outside door 30 should it be subjected to shock from a hammer or the like. The silicone also inhibits removal of the outside door 30.

In the event the outside door 30 is breached, the niche 4 is still covered by the inside door 20 which is attached with inside security screws 22 or like tamper proof hardware. Vandals must also then breach the inside door 20 as well to gain access to the niche 4.

The first set of tamper proof hardware, security screws 22 that hold the inside door in place, is concealed by the outside door 30 when the outside door 30 is installed. For added security the inside and outside security screws 22, 33 can each require a different tool for removal. Thus even if a vandal brings a tool that is suitable for removing the normally visible outside security screws 33, he will not be able to see the inside security screws 22 to determine what tool is needed to remove them until after he has removed the outside door 30. Vandals are not often so well prepared and equipped, and will be stymied.

Vandals are also not able to determine the location of the normally concealed inside security screws. Where it is required for authorized personnel to gain access to a niche 4 where the outside door 30 is stuck to the inside door 20 by silicone 40 or the like, that person will know that he only has to break away a small piece of the outside door 30 above the known but concealed location of the inside security screws 22 to remove them and thus both doors 20, 30 together.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

I claim:

1. A columbarium apparatus comprising:

a columbarium structure defining a plurality of niches;

wherein each niche is defined by top, bottom, right side, left side, and rear walls and has an open end;

a horizontal ledge extending from the columbarium structure in proximity to the bottom wall of at least one niche;

an inside door configured to cover the open end of the at least one niche and attached to the columbarium structure by a first set of tamper resistant hardware;

an outside door configured to substantially entirely cover the inside door and conceal the first set of tamper resistant hardware;

a resilient material between the inside and outside doors and in contact with an inner face of the outside door and an outer face of the inside door;

the outside door being attached to the columbarium structure by a second set of tamper resistant hardware such that an inner face of the outside door is supported by an outer face of the inside door, and such that a lower edge of the outside door is supported by the ledge;

wherein the first set of tamper resistant hardware requires a first tool for removal, and wherein the second set of tamper resistant hardware requires a different second tool for removal.

2. The apparatus of claim 1 wherein the inside door is made of aluminum and the outside door is made from stone.

3. The apparatus of claim 1 wherein the outside door is attached to the columbarium structure by attachment to a vertical strip portion of the columbarium structure.

4. The apparatus of claim 1 further comprising a channel member adjacent to one side of the niche defining a recess oriented to accommodate an edge of the outside door.

5. The apparatus of claim 1 wherein the resilient material is a silicone compound.

6. The apparatus of claim 1 wherein the columbarium structure is substantially aluminum and wherein the tamper resistant hardware comprises stainless steel or brass.

7. A columbarium apparatus comprising:

a columbarium structure defining a plurality of niches, and each niche having an open end;

an inside door configured to cover the open end of the niche and attached to the columbarium structure by a first set of tamper resistant hardware;

an outside door configured to cover the inside door and attached to the columbarium structure by a second set of tamper resistant hardware such that an inner face of the outside door is supported by an outer face of the inside door;

wherein the first set of tamper resistant hardware is concealed by the outside door when the outside door is installed;

wherein the first set of tamper resistant hardware requires a first tool for removal, and wherein the second set of tamper resistant hardware requires a different second tool for removal wherein the columbarium further comprising a resilient material between the inside and outside doors and in contact with the inner face of the outside door and the outer face of the inside door, a ledge extending from the columbarium structure in proximity to the bottom wall of at least one niche, wherein the horizontal ledge is configured to support a lower edge of the outside door.

* * * * *

UNITED STATES PATENT AND TRADEMARK OFFICE

CERTIFICATE OF CORRECTION

PATENT NO. : 7,415,800 B2
APPLICATION NO. : 10/731046
DATED : August 26, 2008
INVENTOR(S) : Harry Stienwand It is certified that error appears in the above-identified patent and that said Letters Patent is hereby corrected as shown below:

Title Page, insert Item (73) Assignee to read
-- (73) Assignee:
Kootenay Monument Incorporated
8680 Highway 95A
Kimberley, British Columbia
CANADA V1A 3M3 --.

Signed and Sealed this

Twentieth Day of January, 2009

JON W. DUDAS
*Director of the United States Patent and Trademark Office*